United States Patent [19]

Rieckenberg

[11] 4,404,751

[45] Sep. 20, 1983

[54] HAND TOOL FOR MOUNTING AN ELECTRICAL BOX

[76] Inventor: Ivan L. Rieckenberg, Rte. 1, Box 148E, Steeleville, Ill. 62288

[21] Appl. No.: 358,840

[22] Filed: Mar. 16, 1982

[51] Int. Cl.[3] ..... B25B 1/00

[52] U.S. Cl. ..... 33/180 R; 33/DIG. 10; 33/168 R; 269/3; 269/902; 269/904

[58] Field of Search ..... 269/904, 902, 3; 33/168 R, 180 R, DIG. 10; 81/177 R, 177 C; 145/61 R, 61 C

[56] References Cited

U.S. PATENT DOCUMENTS

| | | | |
|---|---|---|---|
| 387,284 | 8/1888 | Dupee | 33/168 R |
| 1,045,871 | 12/1912 | Miller | 33/168 R |
| 1,389,486 | 8/1921 | Brewes | 33/168 R |
| 1,980,087 | 11/1934 | Rast | 145/61 C |
| 2,585,641 | 2/1952 | Faso | 81/177 C |
| 2,919,913 | 1/1960 | Phair . | |
| 2,956,798 | 10/1960 | Briggs . | |
| 2,990,172 | 6/1961 | Gianotta . | |
| 3,154,304 | 10/1964 | Crawford | 269/904 |
| 3,436,070 | 4/1969 | Utley et al. . | |
| 3,482,322 | 12/1969 | Kanemitsu | 33/168 R |
| 3,524,239 | 8/1970 | Lewis | 269/904 |
| 3,751,026 | 8/1973 | Stickney . | |
| 3,954,717 | 5/1976 | Tarr . | |
| 4,150,488 | 4/1979 | Behnke | 33/168 R |
| 4,181,295 | 1/1980 | Duffy | 269/904 |

*Primary Examiner*—Robert C. Watson

*Attorney, Agent, or Firm*—Kinzer, Plyer, Dorn & McEachran

[57] ABSTRACT

A hand tool for mounting an electrical box on a wall stud or other structural member comprises a jig of V-shaped construction that has a linear primary gauge surface at the upper end of a first leg for engaging the outer face of the stud, a secondary gauge surface in the base of the V for engaging the rim of an electrical box wall, one or more additional secondary gauge surfaces formed as steps on the second leg of the V, and a linear tertiary gauge surface at the top of the second leg for engaging the inner surface of the box; a finger grip mounted on the second leg of the jig enables a workman to hold the jig and box against a stud, with one hand, and to mount the box on the stud with its rim at any one of two or more predetermined distances from the stud surface, depending on the number of secondary gauge surfaces provided. A simplified embodiment having only one secondary gauge surface is also described.

8 Claims, 5 Drawing Figures

HAND TOOL FOR MOUNTING AN ELECTRICAL BOX

BACKGROUND OF THE INVENTION

In mounting an electrical box for housing a switch, a receptacle, or a lighting fixture on a wall stud, a ceiling joist, or like structural member, it is important to have the rim of the box positioned at the right depth relative to the outer surface of the completed wall, whether that surface is formed by plaster, by plasterboard, by panelling, or by some other wall surfacing. It is usually desirable that the rim of the box be located so that it is recessed about 1/16 inch from the finished wall surface. The positioning of the electrical box is most critical for plasterboard and panelled walls, since these walls do not have the flexibility of thickness adjustment that is possible with a plastered wall. It is rather difficult and time-consuming for the electrician or other workman to mount the electrical box accurately on a wall stud or joist to achieve this end result.

In the past, there have been a variety of proposals for jig and gauge devices to determine the position of an electrical box for mounting on a wall stud. For the most part, these devices have been designed to determine both the height of the electrical box above the floor and the depth of the box rim relative to the outer face of a stud. The result has been apparatus that is too large, too complex, and too expensive for most electricians and other workmen. Devices of this kind are described in Phair U.S. Pat. No. 2,919,913, Briggs U.S. Pat. No. 2,956,798, Hodgson U.S. Pat. No. 2,962,281, Gianotta U.S. Pat. No. 2,990,172, Utley et al U.S. Pat. No. 3,436,070, Stickney U.S. Pat. No. 3,751,026, and Tarr U.S. Pat. No. 3,954,717. Copies of all of these patents accompany this application.

In most construction projects, the height of an electrical switch or receptacle above the floor is not critical; displacement of an inch or two above or below a desired height is of no consequence. Furthermore, height location is readily accomplished with an ordinary workman's measuring tape. Thus, the height gauge provisions of the more common prior art devices are really not necessary; they impose an economical burden on the workman or contractor and add unnecessarily to the bulk and weight of the tools that must be carried by the workman.

One prior art device evidences a more sensible approach, in that it omits any provision for determination of height of the electrical box above a floor and concentrates on the critical factor, the depth of box mounting. This device is described in Crawford U.S. Pat. No. 3,154,304. However, the Crawford device is still relatively complex and expensive, incorporating a plurality of grippers, mechanical adjustments, and other moving parts.

What is really needed is a simple hand tool or jig that can be carried conveniently by a workman and can be used, whenever required, for accurate positioning of an electrical box on a stud or joist so that precise alignment of the rim of the box with respect to the outer surface of the finished wall is assured. This hand tool should require no adjustments on the part of the electrician and should enable the workman to carry out the job using only the usual tools of the trade and the workman's own hands, with no adjustment necessary for the hand tool during use.

SUMMARY OF THE INVENTION

It is a primary object of the present invention, therefore, to provide a new and improved hand tool, small in size and light in weight, that enables a workman to mount an electrical box on a stud or like structural member by holding the device and the box in position with one hand while securing the box to the structural member with the other hand.

A particular object of the invention is to provide a new and improved hand tool, for mounting an electrical box at a precisely located depth on a wall stud or other structural member, that is simple and economical in construction and that requires no adjustment on the part of the workman using the tool.

An important feature of the invention is the incorporation of all of the required gauging surfaces for a hand tool adapted for accurate mounting of an electrical box on a wall stud or other structural member in a single, unitary molded member, preferably of molded plastic.

Accordingly, the invention is directed to a hand tool for use in mounting an electrical box on a structural member, such as a wall stud, with the rim of the box displaced from the outer surface of the structural member by a predetermined distance D. The hand tool comprises a jig of substantially V-shaped cross sectional configuration, including first and second legs joined at a base, the first leg of the jig having an elongated linear primary gauge surface at its upper edge for engaging the outer surface of the structural member, and having an effective height equal to the distance D. The base of the jig has an elongated linear secondary gauge surface for engaging the rim of one wall of an electrical box, the secondary gauge surface extending parallel to the primary gauge surface. The second leg of the jig has a height substantially greater than the height of the first leg but substantially less than the depth of the box, and has a tertiary gauge surface at its upper edge for engaging the inner surface of said one wall of the electrical box. A finger grip is mounted on and extends transversely of the second leg of the jig to enable a workman to hold the jig in place on the rim of an electrical box and to maintain the box and jig in position on the structural member with one hand while securing the box to the structural member with the other hand.

DESCRIPTION OF THE PREFERRED EMBODIMENTS

Figure 1:
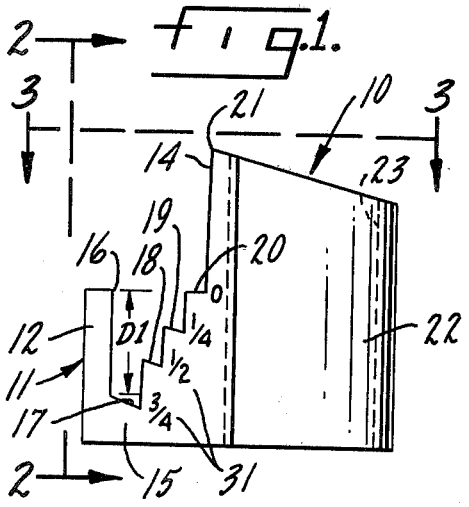
FIG. 1 is a side elevation view of a hand tool for mounting an electrical box on a structural member, constructed in accordance with a preferred embodiment of the invention.
Figure 2:
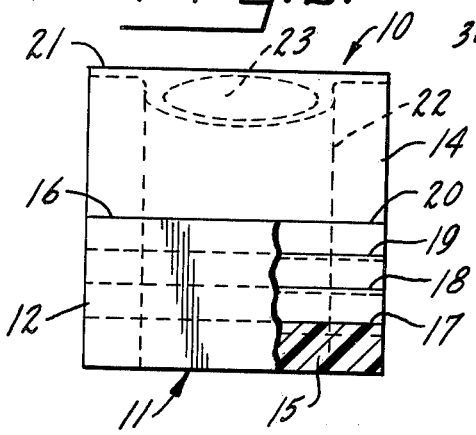
FIG. 2 is a front elevation view taken approximately as indicated by line 2—2 in FIG. 1, with a part of the device cut away to display some of the gauge surfaces.
Figure 3:
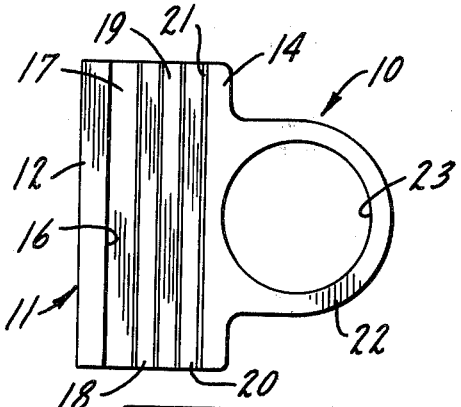
FIG. 3 is a plan view of the tool taken approximately as indicated by line 3—3 of FIG. 1.

FIGS. 1–3 illustrate a hand tool 10 for use in mounting an electrical box on a structural member, such as a wall stud; the hand tool 10 is constructed in accordance with a preferred embodiment of the present invention.

Tool 10 includes a jig 11 of substantially V-shaped cross-sectional configuration (FIG. 1) including a first leg 12 and a second leg 14 joined at a base 15. The first leg 12 of jig 11 has an elongated primary gauge surface 16 at its upper edge. The effective height of gauge surface 16, above the surface 17 of base 15, is a predetermined distance D1. Distance D1 corresponds to the desired depth of mounting of an electrical box, from the outer surface of a wall stud or like structural member, for a wall of predetermined thickness.

Surface 17 of jig base 15 constitutes an elongated linear secondary gauge surface for engaging the rim of one wall of an electrical box, as described hereinafter in connection with FIG. 4. This secondary gauge surface 17 extends parallel to the primary gauge surface 16.

The second leg 14 of jig 11 is of stepped configuration and provides a plurality of additional secondary gauge surfaces 18, 19 and 20. Each of the secondary gauge surfaces 18–20 is parallel to the primary gauge surface 16. The vertical displacement of each of the secondary gauge surfaces 18 and 19 from the primary gauge surface 16 corresponds to a given wall thickness; gauge surface 20 is utilized for mounting an electrical box with its rim surface flush or slightly recessed relative to the outer surface of a wall stud.

The second leg 14 of jig 11 has a height substantially greater than the height of the first leg 12 but substantially less than the depth of an electrical box. The upper edge 21 of jig leg 14 affords an elongated linear tertiary gauge surface which, in use, is engaged with the inner surface of one wall of an electrical box. Gauge surface 21 is parallel to the primary gauge surface 16 and, accordingly, is also parallel to each of the secondary gauge surfaces 17–20.

Hand tool 10 further comprises a finger grip 22 which is mounted on and extends transversely of the second leg 14 of jig 11. In the illustrated construction, the finger grip 22 has a single central opening 23 sized to fit the workman's thumb; opening 23 is preferably about one inch in diameter. If desired, finger grip 22 can be formed with plural openings for use with fingers other than the thumb.

Figure 4:
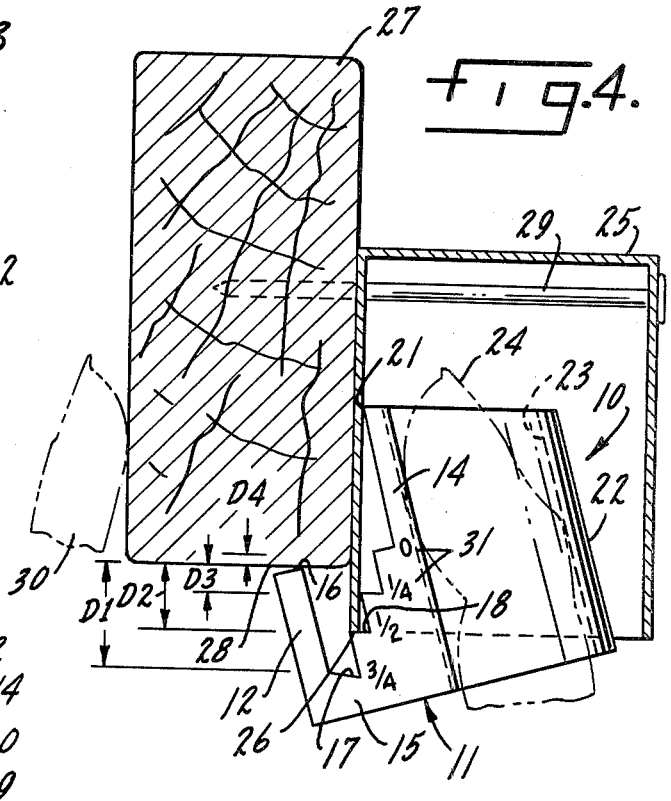
FIG. 4 illustrates the tool of FIGS. 1–3 in use in installing an electrical box on a wall stud, with one wall of the box cut away to show the position of the tool.

The manner in which hand tool 10 is used by a workman in installing an electrical box on a wall stud or other structural member can best be understood with reference to FIG. 4. At the outset, one thumb of the workman, shown as the left thumb by the phantom outline 24 in FIG. 4, is inserted into finger grip 22. An electrical box 25 is then mounted on hand tool 10 as shown in FIG. 4, with one of the secondary gauge surfaces of the device engaging the rim 26 of one wall of the box and with the tertiary gauge surface 21 engaging the inner surface of the same box wall.

Holding box 25 and tool 10 firmly together, the workman next places the box on a wall stud 27 as shown in FIG. 4. The left hand of the workman (thumb 24 and one or more fingers 30) is effective to maintain the box firmly in place. The primary gauge surface 16 of tool 10 engages the outer face 28 of stud 27 so that the box rim 26 is maintained in a precisely determined position relative to the outer face of the stud. In this instance, the rim 26 of box 25 is engaged with secondary gauge surface 18 and the distance from the rim to the outer face of the stud is the distance D2.

While holding box 25 in position as shown in FIG. 4, it is a relatively simple matter for the workman to place nails in the usual apertures in box 25 and drive those nails home into stud 27 to anchor box 25 firmly to the stud. This is shown by nail 29 in FIG. 4. When two nails 29 have been driven in place, box 25 is firmly anchored to the stud and its rim 26 is precisely positioned at the required displacement D2 from the outer surface 28 of the stud.

Tool 10, as shown in FIGS. 1–4, is effective to provide arcuate mounting of electrical boxes for three different wall thicknesses and for flush mounting. Thus, the effective distance D1 for secondary gauge surface 17 may be 11/16 inch, for use with a plasterboard or other wall member thickness of $\frac{3}{4}$ inch. Dimension D2, for gauge surface 18, may be 7/16 inch, corresponding to the required mounting displacement for an electrical box in a wall having a thickness of $\frac{1}{2}$ inch. Dimension D3, attained when gauge surface 19 is used, may be 3/16 inch, for use with panelling or other wall surfacing having a thickness of $\frac{1}{4}$ inch. When the flush secondary gauge mounting surface 20 is used, a negative displacement D4 of approximately 1/16 inch is attained; however, if desired, the configuration of tool 11 may be such that the dimension D4 is effectively zero. Tool 10 may be provided with suitable indicia 31, as shown in FIGS. 1 and 4, to identify secondary gauge surfaces to be used for different wall thicknesses.

As will be readily apparent from the foregoing description, the hand tool 10 enables a workman to mount an electrical box on a wall stud, a ceiling joist, or other structural member, with the rim of the box displaced from the outer surface of that structural member by any one of the four predetermined distances D1–D4. The complete operation is effected with the workman using one hand to hold the tool and box in place and the other hand to secure the box to the structural member. No additional tools are required, apart from those normally used in mounting the box, such as a hammer. There is nothing to adjust on hand tool 10. Furthermore, the entire tool is formed as a unitary molded member, including both jig 11 and finger grip 22; this is preferably a molded plastic member to keep the weight down, since the tool is not required to sustain any substantial stress or abrasion. Thus, tool 10 has the additional advantage of being light in weight and small in size, easily carried about on the job.

Figure 5:
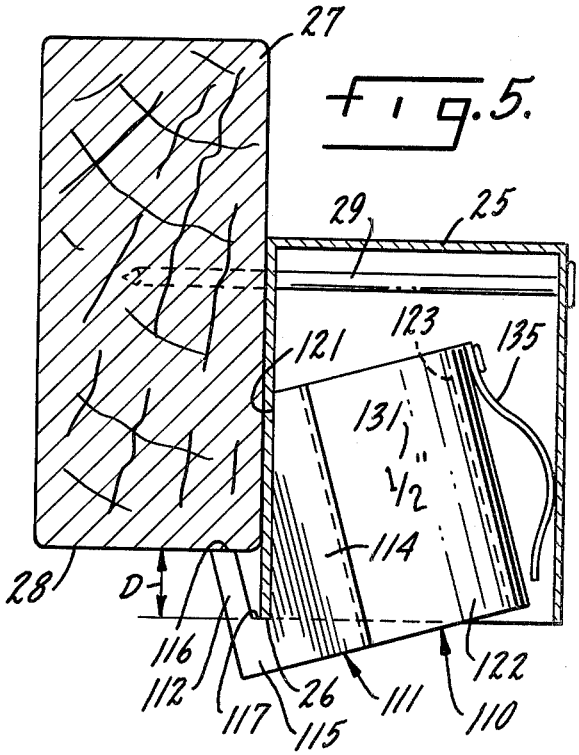
FIG. 5 is a view similar to FIG. 4 but showing another embodiment of the invention.

FIG. 5 illustrates a construction and use of a modified hand tool 110 comprising another embodiment of the invention. Tool 110 includes a V-shaped jig portion 111 comprising a first leg 112 joined to a longer second leg 114 by a base 115. As before, the upper end of leg 112 constitutes a primary gauge surface 116 for engaging the outer surface 28 of a stud 27. The jig base 115 includes a secondary gauge surface 117 for engaging the rim 26 of an electrical box 25. The entire surface of leg 114 that faces leg 112 constitutes a tertiary gauge surface 121 for engaging the inner surface of the electrical box wall.

Hand tool 110 further comprises a finger grip 122 that is mounted on and extends transversely of the second leg 114 of jig 111. As before, the finger grip 122 has a single central opening 123. In the illustrated construction, a spring 135 is affixed to finger grip 122 and this spring engages the inner surface of a wall of box 25 opposite the wall engaged by the secondary gauge surface 117. Preferably, the entire hand tool 110, apart from spring 135, is formed as a single, unitary molded plastic member.

The use of hand tool 110 is the same as described above for tool 10. A workman inserts a thumb in the opening 123 of finger grip 122 and positions tool 110 in an electrical box 25 as shown in FIG. 5. Spring 135 assists in holding tool 110 in the desired position on the rim of the box, with the rim engaging the secondary gauge surface 117 and the box wall engaging tertiary gauge surface 121. With one hand, the workman then positions the box and tool on a stud 27, primary gauge surface 116 serving to assure accurate alignment of the box with its rim 26 displaced a predetermined distance D from the outer surface 28 of the stud. One or more nails 29 can then be inserted through the box and driven into stud 27 to complete mounting of the box. With this embodiment, it is anticipated that a series of hand tools 110 would be provided for a workman, one for each common wall thickness. As illustrated in FIG. 5, the distance D is preferably 7/16 inch, for a wall thickness of ½ inch and the wall thickness ½ inch is marked on hand tool 110 by indicia 131.

I claim:

1. A hand tool for use in mounting an electrical box on a structural member, such as a wall stud, with the rim of the box displaced from the outer surface of the structural member by a predetermined distance D, comprising:

a jig of substantially V-shaped cross sectional configuration, including first and second rigid legs joined at a base;

the first leg of the jig having an elongated linear primary gauge surface at its upper edge for engaging the outer surface of the structural member, and having an effective height equal to the distance D;

the base of the jig having an elongated linear secondary gauge surface for engaging the rim of one wall of an electrical box, the secondary gauge surface extending parallel to the primary gauge surface;

the second leg of the jig having a height substantially greater than the height of the first leg but substantially less than the depth of the box and having a tertiary gauge surface at its upper edge for engaging the inner surface of said one wall of the electrical box;

and a finger grip mounted on and extending transversely on the second leg of the jig to enable a workman to hold the jig in place on the rim of an electrical box and to maintain the box and jig in position on the structural member with one hand while securing the box to the structural member with the other hand;

the entire tool constituting a single, unitary molded member.

2. A hand tool for use in mounting an electrical box on a structural member, such as a wall stud, with the rim of the box displaced from the outer surface of the structural member by any one of a series of at least two pre-determined distances D1, D2 of diminishing size, comprising:

a jig, including first and and second legs joined at a base and displaced from each other to receive one wall of an electrical box therebetween;

the first leg of the jig having an elongated linear primary gauge surface of its upper edge for engaging the outer surface of the structural member, and having an effective height equal to the largest distance D1;

the base of the jig having an elongated linear secondary gauge surface for engaging the rim of one wall of an electrical box, the secondary gauge surface extending parallel to the primary gauge surface;

the second leg of the jig having a height substantially greater than the height of the first leg but substantially less than the depth of the box and having a tertiary gauge surface at its upper edge for engaging the inner surface of said one wall of the electrical box;

the second leg of the jib being of stepped configuration providing at least one additional secondary gauge surface spaced from the primary gauge surface by an effective height equal to the distance D2;

and a finger grip mounted on and extending transversely of the second leg of the jig to enable a workman to hold the jig in place on the rim of an electrical box and to maintain the box and jig in position on the structural member with one hand while securing the box to the structural member with the other hand.

3. A hand tool according to claim 2 in which the second leg of the jig includes at least two secondary gauge surfaces.

4. A hand tool according to claim 2, or claim 3, in which the tertiary gauge surface is an elongated linear surface parallel to the primary and secondary gauge surfaces.

5. A hand tool according to claim 4 in which the entire tool is a single, unitary, molded member.

6. A hand tool according to claim 5 in which the tool is formed of molded plastic.

7. A hand tool according to claim 2, or claim 3, in which the entire tool is a single, unitary, molded member.

8. A hand tool according to claim 1 in which the tool is formed of molded plastic.

* * * * *